US005817990A

United States Patent [19]

Furse

[11] Patent Number: 5,817,990

[45] Date of Patent: Oct. 6, 1998

[54] WALL STRUCTURE FOR SOUND ATTENUATING APPARATUS

[75] Inventor: John H. Furse, Louisville, Ky.

[73] Assignee: AAF International, Louisville, Ky.

[21] Appl. No.: 686,310

[22] Filed: Jul. 25, 1996

[51] Int. Cl.[6] ..... F04F 17/04

[52] U.S. Cl. ..... 181/224; 181/284; 181/293; 52/144; 52/145; 52/783.11

[58] Field of Search ..... 52/144, 145, 783.1, 52/783.11, 794.1; 181/224, 225, 290, 293, 287, 284

[56] References Cited

U.S. PATENT DOCUMENTS

| | | | |
|---|---|---|---|
| 2,842,222 | 7/1958 | Hughett | 52/144 |
| 2,994,401 | 8/1961 | Bourne et al. | 181/224 |
| 3,511,337 | 5/1970 | Pease et al. | 181/224 |
| 3,583,123 | 6/1971 | Holmgren et al. | 52/783.11 X |
| 3,611,907 | 10/1971 | Wasserman et al. | 98/33 |
| 3,642,093 | 2/1972 | Schach | 181/50 |
| 3,715,846 | 2/1973 | Sullhofer | 52/783.11 X |
| 3,946,528 | 3/1976 | Jacobson et al. | 52/79 |
| 4,093,039 | 6/1978 | Moore et al. | 181/229 |
| 4,127,183 | 11/1978 | McLarty | 181/224 |
| 4,287,962 | 9/1981 | Ingard et al. | 181/224 |
| 4,838,524 | 6/1989 | McKeown et al. | 52/145 X |
| 5,532,439 | 7/1996 | Minkin | 181/224 |

*Primary Examiner*—Winnie S. Yip
*Attorney, Agent, or Firm*—Polster, Lieder, Woodruff & Lucchesi

[57] ABSTRACT

A sound attenuating apparatus for noise bearing fluid streams wherein elongated perforated wall forming panel sheets include integrally formed indentations extending along a direction transverse the direction of the fluid stream to provide strength and stiffeners for the perforated panel sheets.

7 Claims, 2 Drawing Sheets

WALL STRUCTURE FOR SOUND ATTENUATING APPARATUS

BACKGROUND OF THE INVENTION

The present invention relates to sound attenuation apparatus for noise bearing fluid streams and more particularly to a unique and novel sound attenuation apparatus which includes longitudinally extending spaced sound attenuating wall assemblies mounted in a flow-through housing with the spaced perforated plates of each sound attenuating wall assembly having integral strength and stiffener members to increase wall strength and to reduce parts, welding and contaminant spatter.

Silencer splitter wall or panel assemblies including substantially parallel, spaced, perforated elongated panel sheets defining a sound attenuating chamber therebetween have been generally well known in the sound control art. The elongated panel sheets have been mounted on a steel grid structural support frame including a peripheral outer frame structure and spaced internal structural support members extending between and intermediate the spaced perforated panel sheets. These frame support structures with internal support members have been welded together and the defined chambers have served to contain mineral wool sound attenuating fillers wrapped in fiberglass cloth. The welding of perforated panel sheets to the outer frame structure and the internal support members has not only proved time and labor consuming, as well as labor extensive, but weld spatter resulting from numerous tack welds often contaminates the final assembly, the spatter possibly becoming dislodged to be entrained in the attenuated fluid stream, creating serious problems with downstream machinery, such as gas turbines.

In U.S. Pat. No. 3,611,907, issued to S. Wasserman et al on Oct. 12, 1971, a general panel assembly similar to the panel construction above discussed is disclosed. Similar panel construction of the prior art also is shown in U.S. Pat. Nos. 3,642,093, issued to A. W. Schach on Feb. 15, 1972 and 3,946,528, issued to I. A. Jacobson et al on Mar. 30, 1976. In fact, in an air intake silencer disclosed in U.S. Pat. No. 4,093,039, issued to J. W. Moore et al on Jun. 6, 1978, integral strength and stiffener ribs are disclosed in association with the defining walls of an expansion chamber. However, none of the noted references of the prior art teaches or even remotely suggests the unique flow-through housing wall or panel assembly as is set forth herein.

In accordance with the present invention, an improved structure for wall panel assemblies of flow-through sound attenuating housings is disclosed, the novel structure being economical and straight forward in construction and maintenance, requiring a comparative minimum of parts, time and labor and at the same time providing for efficient operation without undue pressure drop and with a minimum of weld spatter carryover which has been often so worrisome in the past wall or panel assemblies for sound attenuating housing of the splitter panel types.

Various other features of the present invention will become obvious to one skilled in the art upon reading the disclosure set forth herein.

BRIEF SUMMARY OF THE INVENTION

More particularly the present invention provides a sound attenuating apparatus for noise bearing fluid streams comprising a fluid stream flow-through housing including an upstream inlet end and a spaced downstream outlet end; elongated, perforated panel sheet means extending between the spaced upstream housing inlet and outlet ends, the panel sheet means including spaced panel sheets providing perforated wall assemblies defining at least one elongated fluid flow-through passage for noise bearing fluid streams to be attenuated; sound absorbing means positioned adjacent the spaced panel sheets outside the flow-through passage to absorb and attenuate noise from the noise bearing fluid stream passing through the flow-through passage; and, indentation means integrally formed as part of the panel sheet means to strengthen and stiffen the panel/sheet means, furnishing strength and support therefor without intermediate support members. In addition, the present invention provides a uniquely formed integral strength and stiffener to minimize fluid stream pressure drop with integral strength and stiffeners of opposed panel sheets being relatively offset and of preselected depth.

It is to be understood that various changes can be made by one skilled in the art in one or more of the several parts of the structural arrangement set forth herein without departing from the scope or spirit of the present invention.

BRIEF DESCRIPTION OF THE DRAWINGS

Referring to the drawings which disclose one advantageous embodiment of the present invention and modifications thereto.

DETAILED DESCRIPTION OF THE DRAWINGS

Figure 1:
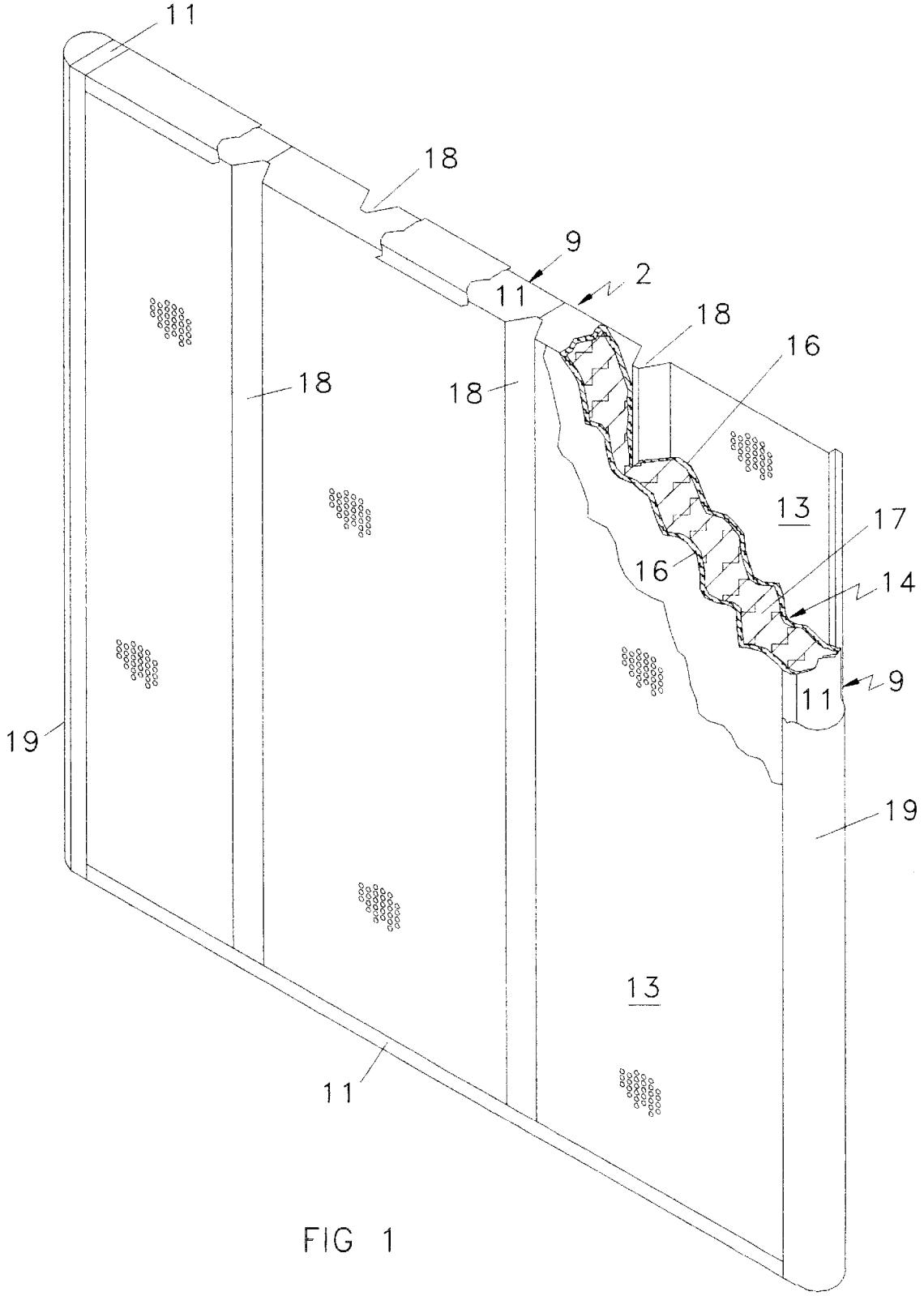
FIG. 1 is a partially broken away isometric view of a sound attenuating wall or panel assembly with the panel sheets incorporating the novel, integral indented strength and stiffeners of the present invention.
Figure 2:
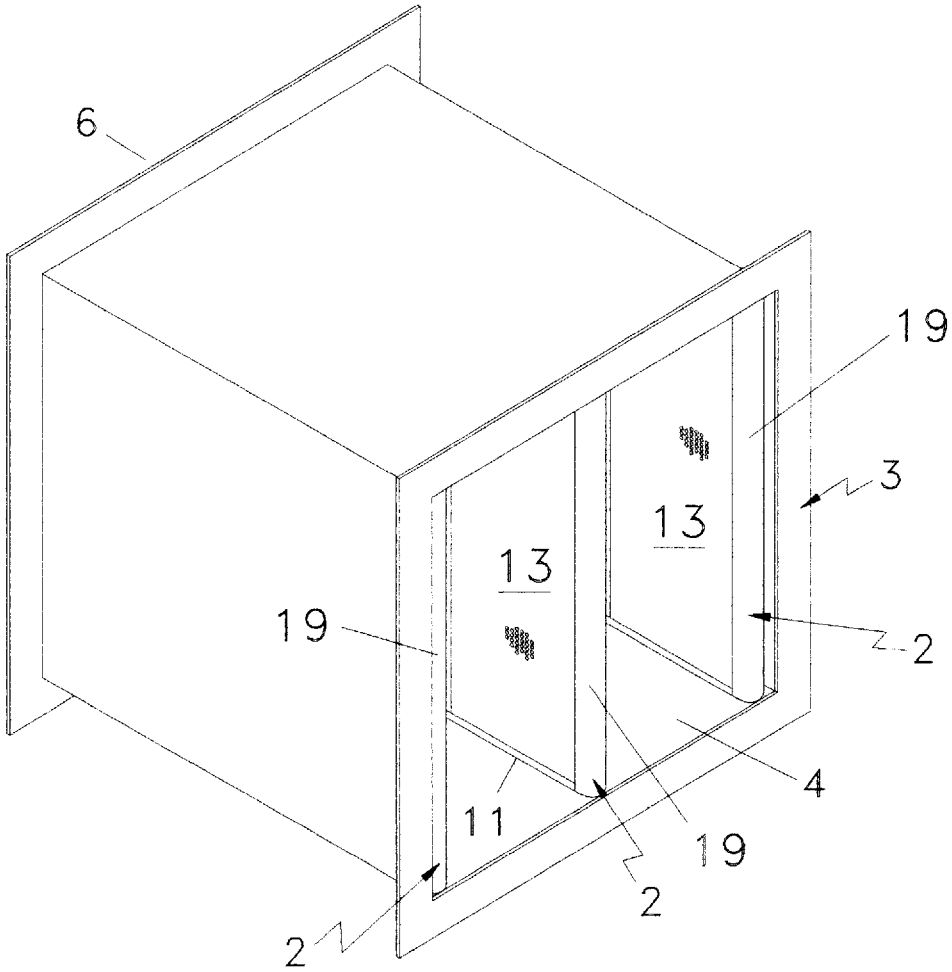
FIG. 2 is an isometric front end view of a flow-through housing, incorporating spaced, novel wall or panel assemblies similar to tho FIG. 1; and, FIGS. 3 and 4 are enlarged cross-sectional exemplifying views of modifications of the integral indented strength and stiffener channels of FIGS. 1 and 2, the one disclosed, exemplifying channel being formed along a panel sheet face opposite the flow-through passage panel sheet face with the strength and stiffener channel being normal to the inner panel sheet face (FIG. 3) and with the major body portion of the strength and stiffener channel sloping in a direction opposite the fluid stream flow direction (FIG. 4).

Referring particularly to FIG. 2 of the drawings, the novel sound attenuating assembly apparatus 2 for noise bearing fluid streams (FIG. 1) is disclosed as included in a unit housing 3, housing 3 having an upstream housing inlet end 4 and a spaced downstream outlet end 6. The unit housing 3 can be made from any one of a number of suitable structural materials and advantageously is formed from a galvanized or stainless steel. The unit housing 3 includes several spaced inventive wall or panel assemblies 2, one of such inventive wall or panel assemblies being disclosed in partially broken away fashion in the isometric structure of FIG. 1 of the drawings. Each wall or panel assembly 2, as disclosed, includes a skeletal support frame 9 of minimal structure to include four edge surrounding channels 11 of U-shaped cross-section, two of which form the opposed top and bottom sides of here disclosed rectangular wall or panel assembly 2 and the other two of which form the opposed front and rear sides. The skeletal support frame 9 can be formed from any one of a number of suitable materials and advantageously, also can be of galvanized or stainless steel of a preselected gauge. The pair of spaced, perforated panel sheets 13 forming the wall or panel assembly 2 sides can be of lighter gauge. It is to be noted that sheets 13 are of flexibly formable material for reasons discussed hereinafter. It further is to be noted that only a minimal amount of welding is utilized in forming skeletal frame 9 and in fastening the outer edges of spaced perforated panel sheets 13 to the U-shaped channels 11 which form skeletal frame 9. This desired feature serves to minimize the amount of weld spatter which spatter could possibly migrate into the noise bearing fluid streams to be attenuated. In addition, it is to be noted that the geometry and size of the inventive structure described herein can vary in accordance with the nature and volume of the noise bearing fluid streams to be attenuated. In this regard, frequently each panel sheet can be dimensioned to measure nine (9) feet or more in length and four (4) feet or more in width. In the past, with spaced sheets of such size, it had been found necessary to use structural brace members at frequent intervals. This has occasioned numerous welds with concomitant increased weld spatter in high risk locations thus increasing the possibilities of undesireable fluid stream entrainment.

In accordance with the present invention, the spaced wall or panel assemblies 2 can be mounted in each housing unit 3, with a nominal amount of edge welding to the housing or can even be mounted in a floating fashion between housing channel guides, to extend longitudinally from the inlet end 4 of a housing unit 3 to the outlet end 6. Each wall or panel assembly 2 as aforedescribed, include a pair of spaced, opposed elongated, perforated metallic panel sheets 13 joined by nominal welding along the edges to the skeletal forming U-shaped channel members 11. These spaced opposed perforated sheets 13 serve to define a sound absorbing and attenuating chamber therebetween. Joined streamlined flow channels 19 of U-shaped cross-section can be fastened to the inlet and outlet extremities of panel assembly 2. Disposed in the defined chamber to substantially fill the same is an elongated pillow-like sound absorbing and attenuating unit 14. Pillow-like unit 14 can include a noise permeable elongated fiberglass casing 16 with a sound absorbing rock wool sound absorbing mineral filler 17. It is to be understood that the present invention is not to be considered as limited to the particular casing and filler materials described herein, but that other materials can be used for both casing and filler as might be determined by the noise bearing fluid stream involved.

According to one feature of the present invention, the aforedescribed undesirable support members between the spaced apart perforated sheets are avoided by integrally forming longitudinal indentation stiffener and strengthening channels 18 in panel sheets 13, the indented integral stiffener and strengthening channels 18 advantageously extending longitudinally from one edge of a perforated panel sheet to the opposite edge in a transverse direction to the direction of flow of the noise bearing fluid stream. Each perforated sheet 13 of a pair of sheets of a panel or wall assembly 2 advantageously can be provided with at least two spaced, longitudinally extending indentation, stiffener and strengthening channels 18, with the spaced strength and stiffener channels 18 of one panel sheet 13 of a pair being spacedly offset in the direction of flow from the spaced indented stiffener and strengthening channels on the opposite panel sheet of a pair of sheets 13 and with the indented strengthening and stiffener 18 channels advantageously being less in cross-sectional depth than one half (½) the distance between the spaced opposed panel sheets of the pair.

In the embodiment disclosed in FIG. 1 of the drawings, the indented strengthening and stiffener channels 18 are shown as formed on panel sheets 13 on the panel sheet faces thereof which extend along the noise bearing fluid passage.

Figure 3:
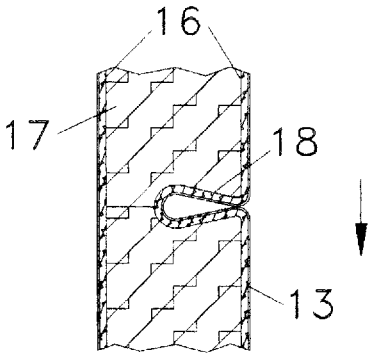
Figure 4:
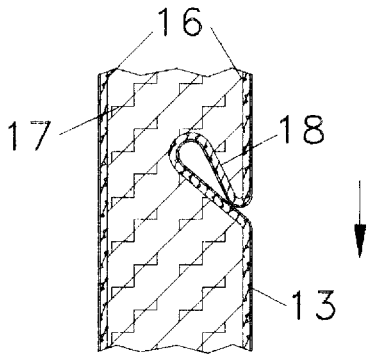

As shown in FIGS. 3 and 4, the indentated strengthening and stiffener channels 18 can be formed along the panel sheet face opposite the noise bearing fluid flow passage with a minimum opening along the panel sheet face of the fluid passage so as to minimize fluid flow interference with concomitant pressure drop. As can be particularly seen in FIG. 4, the major longitudinal portion of the indented strengthening and stiffener longitudinal channel body can be sloped in a direction opposite the direction of fluid stream flow.

It is to be understood that the present invention is not to be considered as limited to the specific geometry and location of the unique indented strengthening and stiffener channels as disclosed but that other indented geometries and locations could be used, again depending upon the nature of the noise bearing fluid stream to be attenuated.

The invention claimed is:

1. A sound attenuating apparatus for noise bearing fluid streams comprising: a fluid stream flow-through housing including an upstream housing inlet end and a spaced downstream housing outlet end;

elongated, perforated panel sheet means extending between said spaced upstream housing inlet and outlet ends, said panel sheet means including spaced pairs of continuous perforated panel sheets providing at least two spaced wall assemblies to define at least one elongated perforated fluid flow-through passage for said noise bearing fluid stream to be attenuated;

sound absorbing pillow-like encasing means positioned adjacent and between said spaced pairs of panel sheets of said wall assemblies so as to be outside said flow-through passage to absorb and attenuate noise from said noise bearing fluid stream passing through said flow-through passage; and, indented strengthening and stiffener means integrally formed as part of said panel sheet means including indented channels intermediate said upstream housing inlet and housing outlet ends to strengthen and stiffen said panel sheet means, said indented channels furnishing support therefore without substantial interference between said spaced panels and at the same time restraining said pillow-like encasing means, wherein each pair of wall assembly panel sheets are jointed in substantially floating relation along at least one pair of corresponding edges of said housing by a flow channel of U-shaped section.

2. The sound attenuating apparatus of claim 1, wherein said integral indented strengthening and stiffener channels of each pair of said spaced perforated panel sheets are in off-set relation to each other along the direction of fluid stream flow.

3. The sound attenuating apparatus of claim 1, wherein said integral indented strengthening and stiffener channels have cross-sections which are less than one half (½) the spaced distance between said pair of said panel sheets.

4. The sound attenuating apparatus of claim 1, wherein said indented channels are integrally formed with a minimum face opening of panel sheet along said flow-through passages.

5. The sound attenuating apparatus of claim 4, wherein said indented channels are formed along the face of each of said panel sheets in that face adjacent said flow-through passage with the major portion of the cross-section of said channel body sloping in a direction opposite the fluid stream flow direction.

6. The sound attenuating apparatus of claim 1, wherein said sound absorbing pillow-like encasing means disposed between said pairs of panel sheets is a fluid previous pillow-like casing with a mineral wool sound absorbing filler material, said pillow-like casing being sized to extend between and fill the area between said pair of panel sheets.

7. A sound attenuating apparatus for noise bearing fluid streams comprising: a flow-through housing including an upstream housing inlet end and a spaced downstream outlet end;

spaced elongated sound absorbing wall assemblies disposed in said housing to extend longitudinally from said housing inlet end to said housing outlet end, each wall assembly including a pair of spaced, opposed, elongated, perforated metallic panel sheets joined at opposed edges by longitudinally extending channel members of U-shaped cross-section, said spaced opposed, perforated panel sheets defining a substantially uninterrupted sound absorbing and attenuating chamber there between, an elongated pillow-like sound absorbing encasing unit substantially filling said chamber, said unit including a noise permeable elongated fiberglass casing having a sound absorbing rock wool sound absorbing mineral filler disposed in said chamber, said spaced opposed perforated metallic panel sheets each having spaced indented strengthening and stiffener channels integrally formed with said panel sheets and extending in a direction of flow from the spaced indented channels of the opposite panel sheet of a pair and with the indented channel cross-sections being less than one half (½) the distance between said spaced opposed sheets, at the same time restraining said encasing unit said sound absorbing wall assemblies being mounted in spaced, parallel relation within said flow-through housing in substantially floating arrangement with a minimum of welding joints along the edges of said housing and with said strengthening and stiffener channels being formed along the face of said panel sheets opposite said flow-through passage with a minimum opening along the panel sheet faces defining said fluid passage and with the major longitudinal portion of said channel body sloping in a direction opposite the fluid stream direction.

* * * * *